United States Patent [19]

Hayashi

[11] 4,453,509

[45] Jun. 12, 1984

[54] INTERNAL COMBUSTION ENGINE WITH BEARING BEAM STRUCTURE

[75] Inventor: Yoshimasa Hayashi, Yokosuka, Japan

[73] Assignee: Nissan Motor Co., Ltd., Yokohama, Japan

[21] Appl. No.: 351,268

[22] Filed: Feb. 22, 1982

[30] Foreign Application Priority Data

Feb. 24, 1981 [JP] Japan ..... 56-24841[U]

[51] Int. Cl.[3] ..... F02F 7/00

[52] U.S. Cl. ..... 123/195 R; 123/195 S; 123/195 H; 123/198 E; 74/604; 384/429

[58] Field of Search ..... 123/195 R, 195 C, 195 S, 123/198 E; 74/606 R, 604, 574; 384/432, 433, 434, 430, 429

[56] References Cited

U.S. PATENT DOCUMENTS 497,357 5/1893 Strong ..... 384/432

FOREIGN PATENT DOCUMENTS 0472638 4/1947 Belgium .

2850233 5/1979 Fed. Rep. of Germany ... 123/195 C 2135632 12/1972 France .

*Primary Examiner*—Craig R. Feinberg

*Assistant Examiner*—David A. Okonsky

*Attorney, Agent, or Firm*—Schwartz, Jeffery, Schwaab, Mack, Blumenthal & Koch

[57] ABSTRACT

An internal combustion engine comprises a cylinder block having a plurality of cylinder barrels and a plurality of bearing sections for the journals of a crankshaft; a bearing beam structure and including a plurality of main bearing cap sections each of which associates with each cylinder block bearing section to form a bore for rotatably receiving the crankshaft journal, each bearing cap section being formed with first and second projections which are spaced from each other and located opposite to each other with respect to the axis of the bore, and first and second beam members which are independent from but securely connected to the first and second bearing cap section projections, respectively, by bolts, thereby greatly reducing engine noise emission and improving the productivity of the engine.

9 Claims, 6 Drawing Figures

INTERNAL COMBUSTION ENGINE WITH BEARING BEAM STRUCTURE

BACKGROUND OF THE INVENTION

1. Field of the Invention

This invention relates to a low noise level automotive internal combustion engine, and more particularly to the engine equipped with a bearing beam structure for supporting a crankshaft in a manner to improve the mechanical strength of a cylinder block.

2. Description of the Prior Art

In connection with engine noise, noise emitted from a cylinder block skirt section and an oil pan is mainly caused by the vibration of a cylinder block itself. In order to reduce such vibration noise, it seems enough to suppress the vibration, due to explosion torque, applied to a crankshaft by increasing the rigidity of the cylinder block. However, this unavoidably leads to an increase in cylinder block wall thickness and accordingly to a great increase in engine weight, thereby giving rise to new problems such as a reduced fuel economy. In view of this, a variety of propositions have been made to improve the rigidity of the cylinder block while suppressing the increase in cylinder block weight. Of these propositions, attention has been paid to the employment of a bearing beam structure which securely connects a plurality of bearing caps for supporting the crankshaft, in order to improve the mechanical strength of bearing caps and engine parts associated with them.

BRIEF SUMMARY OF THE INVENTION

In accordance with the present invention, an internal combustion engine comprises a cylinder block having a plurality of cylinder barrels and a plurality of bearing sections for the journals of a crankshaft. A bearing beam structure is secured to the bottom part of the cylinder block and includes a plurality of main bearing cap sections. Each bearing cap section associates with each cylinder block bearing section to form a bore for rotatably receiving therein the journal of the crankshaft. The bearing cap section is formed with first and second projections which are spaced from each other and located opposite to each other with respect to the axis of the bore for receiving the crankshaft journal. Additionally, first and second beam members are disposed to be independent from but securely connected to the first and second projections, respectively, of each bearing cap section by bolts.

This arrangement suppresses not only the coming-down vibration of each bearing cap section in the crankshaft axis direction but also the torsional vibration of the cylinder block, thereby noticeably reducing engine noise emission from the engine. Besides, the engine is greatly improved in productivity, facilitating the storage and treatment of the parts of the engine.

BRIEF DESCRIPTION OF THE DRAWINGS

The features and advantages of the internal combustion engine according to the present invention will be more appreciated from the following description taken in conjunction with the accompanying drawings in which like reference numerals and characters designate like parts and elements, in which.

DETAILED DESCRIPTION OF THE INVENTION

Figure 1:
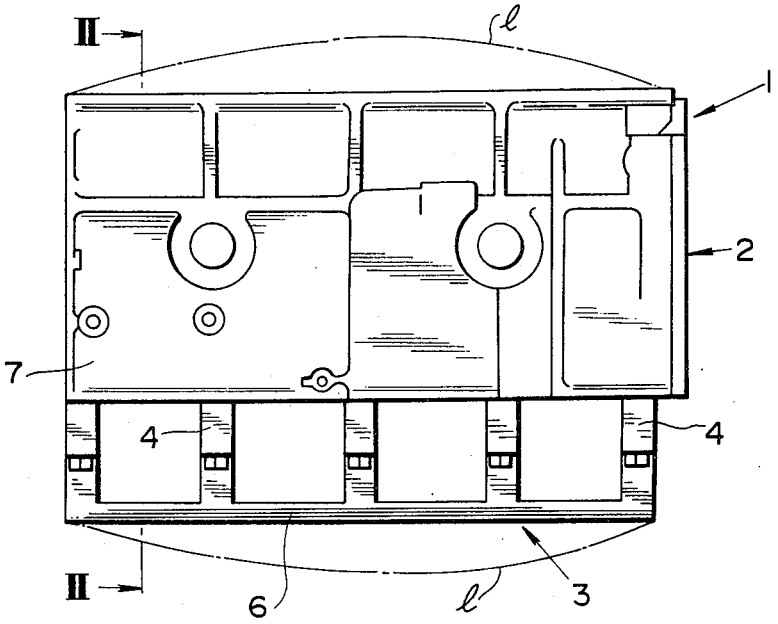
FIG.1 PRIOR ART
FIG. 1 is a front elevation of a conventional internal combustion engine.
Figure 2:
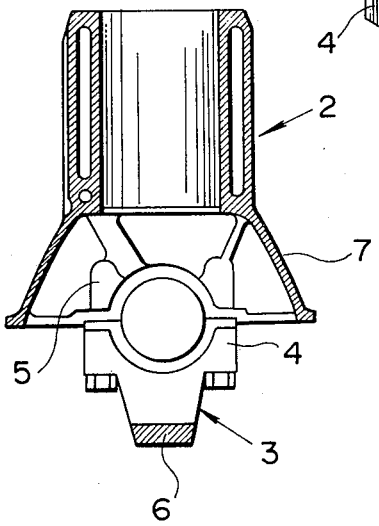
FIG.2 PRIOR ART
FIG. 2 is a vertical sectional view taken in the direction of arrows substantially along the line II—II of FIG. 1.
Figure 3:
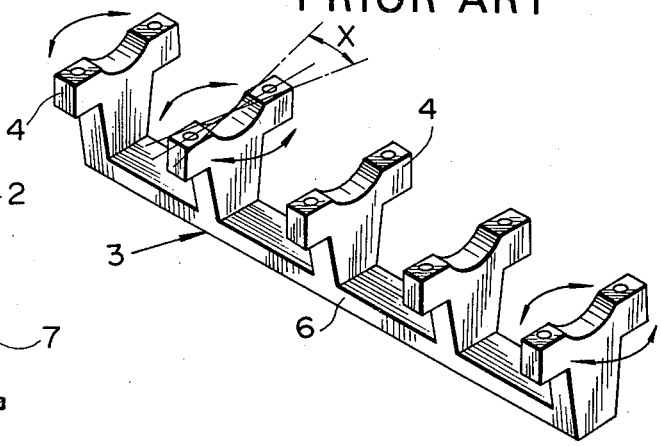
FIG.3 PRIOR ART
FIG. 3 is a perspective view of a conventional bearing beam structure used in the engine of FIG. 1.

To facilitate understanding the invention, a brief reference will be made to an engine block 1 of a conventional automotive internal combustion engine, depicted in FIGS. 1 to 3. Referring to FIGS. 1 and 2, the engine block 1 includes a cylinder block 2, and a bearing beam structure 3 secured to the bottom part of the cylinder block 2 by means of bolts. The bearing beam structure 3 has a plurality of main bearing cap sections 4 each of which associates with each of bearing sections 5 or main bearing bulkheads of the cylinder block 2, as shown in FIG. 3. The thus associated bearing cap section 4 and cylinder block bearing section 5 rotatably support the journal of a crankshaft (not shown). The bearing cap sections 4 are securely or integrally connected with each other through a beam section 6 extending along the axis of the crankshaft, so that the rigidity of the cylinder block 2 can be increased. Therefore, the cylinder block 2 is improved in flexural rigidity against the flexural vibration indicated by dot-dash curves l in FIG. 1, and the bearing cap sections 4 are also improved in flexural rigidity against the vibration in the axial direction of the crankshaft or in the forward-and-rearward direction which vibration so acts on each bearing cap section as as to cause it to come down.

As discussed above, the cylinder block 2 and the bearing cap sections 4 are improved in their mechanical strength. However, it has been confirmed that a desired engine noise reduction cannot be attained. Inventor's studies have shown that, in the above-mentioned conventional bearing beam structure in which only one beam section 6 is disposed at the bottom central portion of the main bearing cap sections 4, a sufficient suppression effect can be obtained against the twist vibration of each bearing cap section 4 in the direction X indicated in FIG. 3, thereby contributing to noise generation. Additionally, inventor's recent experiments have revealed that the lateral vibration in the open-and-close manner of a cylinder block skirt section 7 is mainly caused by the torsion of the main bearing sections 4 and the main bearing bulkheads 5 around the axis of the crankshaft. The thus vibrated cylinder block skirt section not only emits noise therefrom but also excites the vibration of an oil pan (not shown) secured to the skirt section, thereby further emitting noise from the oil pan. As a result, a sufficient noise reduction can not be achieved by the conventional bearing beam structure.

Furthermore, in view of the fact that the beam section 6 is integral with the main bearing cap sections 4 in the conventional bearing beam structure 3, even if only a single defect, such as porosity, occurs during casting, the whole the cast bearing beam structure must be discarded, thereby reducing productivity and contributing to waste of materials. Besides, the conventional bearing beam structures are considerably bulky and are liable to get entangles with each other during their transportation, thereby rendering their storage and treatment difficult.

Figure 4:
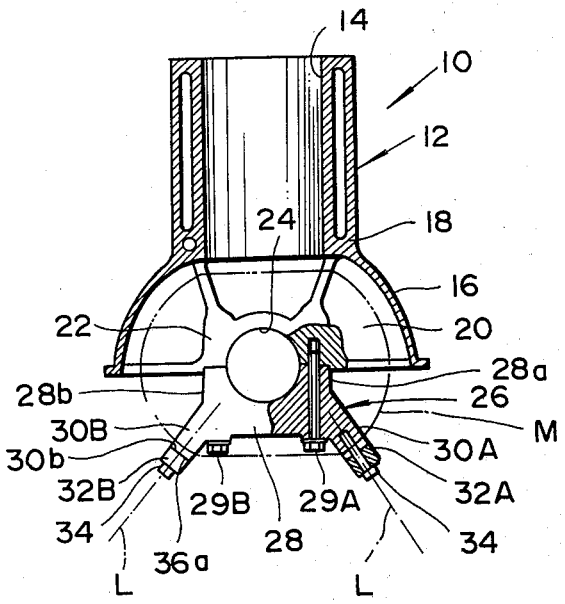
FIG. 4 is a vertical cross-sectional view of a preferred embodiment of an internal combustion engine in accordance with the present invention.
Figure 5:
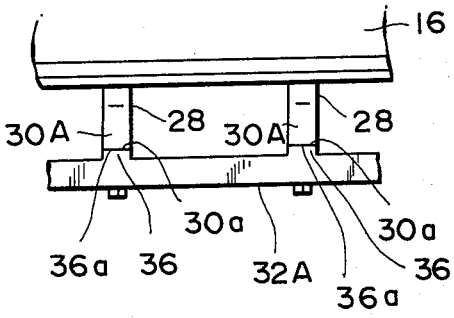
FIG. 5 is a fragmentary side view of the engine of FIG. 4.
Figure 6:
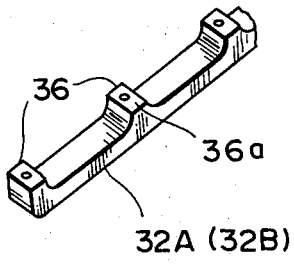
FIG. 6 is a fragmentary perspective view of a beam member of a bearing beam structure of the engine of FIG. 4.

In view of the above description of the automotive internal combustion engine provided with the conventional bearing beam structure, reference is now made to FIGS. 4 to 6, wherein a preferred embodiment of an internal combustion engine of the present invention is illustrated by the reference numeral 10. The engine 10 in this embodiment is for an automotive vehicle and comprises a cylinder block 12 which is formed with a plurality of cylinder barrels 14 each of which defines therein a cylinder bore (no numeral). The cylinder block 12 includes a skirt section 16 which is bulged outwardly and extends downwardly to define thereinside the upper part of a crankcase (no numeral). The skirt section 16 is integrally connected through a lower block deck 18 with the cylinder barrels 14. A plurality of main bearing bulkheads 20 are parallelly disposed inside of the skirt section 16. Each bearing bulkhead 20 is located below and connected to a portion between the adjacent two cylinder barrels 14. The bearing bulkhead 20 is integrally connected at its top part with the lower block deck 18 and at its side parts with the inner wall of the skirt section 16. Each bearing bulkhead 20 is provided at its bottom central portion with a bearing section 22 for rotatably receiving the journal of a crankshaft (no numeral).

A bearing beam structure 26 is securely connected to the bottom section of the cylinder block 12 and includes a plurality of main bearing cap sections 28. Each bearing cap section 28 is secured at its top portion onto a bearing bulkhead 20 by means of cap bolts 29A, 29B so as to associate with the bearing section 22 of the bearing bulkhead 20, thereby defining a cylindrical bore 24 in which the journal of the crankshaft is rotatably supported. In this instance, the bearing cap section 28 is generally in the shape of a rectangular plate and accordingly is formed with the opposite side portions or surfaces **28*a*, 28*b* which are located symmetrical with respect to an imaginary vertical plate containing the crankshaft axis. As shown, each bearing cap section 28 is integrally formed with first and second projections 30A, 30B or installation bases for first and second beam sections 32A, 32B, respectively, which will be discussed hereinafter. The first and second projections 30A, 30B are located at and project from the opposite bottom corner portions, respectively, of each bearing cap section 28, which bottom corner portions are located outside of the cap bolts 29A, 29B, respectively. The bottom corner portions are located opposite, in the vertical direction, to the top corner portions which fit in the cylinder block bearing section 22. In other words, the first and second projections 30A, 30B are positioned symmetrical with each other with respect to the imaginary vertical plane containing the crankshaft axis. The first and second projections 30A, 30B extend downwardly and outwardly in such a manner that the axes of the first and second projections intersect at the same angle the imaginary vertical plane containing the crankshaft axis. The tip surface or installation base surface 30*a*, 30*b* of each projection 30A, 30B** is located outside of the envelope M of the outer-most loci of the big end of a connecting rod for the crankshaft.

The first and second rod-like beam sections or members 32A, 32B are independent from but secured respectively to the first and second projections 30A, 30B of each bearing cap section 28 by means of bolts 34 each of which is screwed and disposed in each projection 30A, 30B. The first and second beam sections 32A, 32B extend parallelly with each other and with the crankshaft axis so that the aligned bearing cap section first projections 30A are securely connected through the first beam member 32A with each other, and the aligned bearing cap section second projections 30B are securely connected through the second beam section 32B with each other. It is preferably that the first and second projections 30A, 30B are so positioned that the extension of the axis of the bolt 34 screwed in each projection is directed to within the cylindrical bore 24, in which the initial tightening forces of the bolts 34 act radially relative to the bearing beam structure 26, thereby improving the rigidity against the torsional vibration of the cylinder block 12.

Additionally, each beam section 32A, 32B is preferably formed with a plurality of projections 36 which are located at predetermined intervals in the longitudinal direction thereof, i.e. at positions corresponding to the projections 30A, 30B of the bearing cap section 28. Each projection 36 of the beam section 32A, 32B is formed at its tip with an installation surface **36*a* which is to be in contact with the installation base surface 30*a*, 30*b* of the projection 30A, 30B. By virtue of this contact between the projections 30A (30B), 36 which are connected with each other by means of the bolts 34, a microscopic sliding is made between the installation base surface 32*a* (32*b*) and the installation surface 36*a***, thereby providing a vibration damping effect.

Thus, according to the present invention, a plurality of main bearing cap sections 28 are rigidly connected with each other by the two beam members 32A, 32B which are symmetrically disposed with respect to the cylindrical bore 24 for receiving the journal of the crankshaft. Therefore, the engine 10 is greatly improved in torsional strength around the crankshaft axis, in addition to the advantageous fact that each bearing cap section 28 is improved in the strength against the vibrations causing the bearing cap section to come down. As a result, the torsional vibration of the bearing bulkheads 20 connected to the bearing cap sections 28 is largely suppressed. This effectively prevents the open-and-close or lateral vibration (membrane vibration) of the skirt section 16 to which the bearing bulkheads 20 are connected to form connecting sections which serve as the nodes of the skirt section vibration, thereby remarkedly decreasing noise emission due to the vibration of the cylinder block skirt section 16 and an oil pan (not shown) secured to the skirt section 16.

Furthermore, since the bearing cap sections 28 are produced separately from the beam members 32A, 32B, the shape of each product or part to be produced by casting is simplified so as to greatly reduce the number of rejects of products due to shrinkage of molten metal or due to incomplete gas vent during the casting of the products. Even in the case where a reject of product or part is made, it is sufficient to discard only that part. This greatly contributes to an improvement in productivity, achieving a lower production cost.

Since the bearing cap sections 28 and the beam members 32A, 32B are separable by removing the bolts 34, the treatment of the engine 10 is facilitated during its transportation; besides the parts of the engine are not bulky, thereby permitting a small space for the storage thereof.

Moreover, it is preferably that the bearing cap sections 28 are made of cast iron, whereas the beam members 32A, 32B are made of light alloy such as aluminum alloy, by which the value of E (Young's modulus)/ρ-(density) can be improved about 30%, thereby achieving weight lightening without lowering rigidity.

As appreciated from the above, according to the present invention, the main bearing cap sections are securely connected with each other by means of the two beam members which are separate from each other and disposed on the right and left sides of the crankshaft axis, the two beam members being respectively secured onto the two projections which are located respectively at the opposite bottom corner portions of each bearing cap section. This effectively suppresses not only the coming-down of the bearing cap sections in the crankshaft axis direction but also the torsional vibration of the cylinder block, thereby noticeably reducing engine noise and and achieving improvement in productivity and treatment of the engine and its parts.

What is claimed is:

1. An internal combustion engine comprising:

a cylinder block having a plurality of cylinder barrels, and a plurality of bearing sections for journals of a crankshaft; and a bearing beam structure secured to a bottom part of said cylinder block and including, a plurality of main bearing cap sections in a row, each of which associates with each cylinder block bearing section to form a bore for rotatably receiving a journal of the crankshaft, each bearing cap section being formed with first and second projections which are spaced from each other and located opposite to each other with respect to an axis of said bore for the crankshaft journal, and elongate first and second beam members extending along the row of said main bearing cap sections and independent from said main bearing cap sections, said first beam member being rigidly connected to all the first projections by bolts and said second beam member being rigidly connected to all said second projections by bolts so as to rigidly connect all said main bearing cap sections.

2. An internal combustion engine as claimed in claim 1, wherein said first and second beam members extend generally straight and are disposed parallel with each other and with the crankshaft axis to rigidly connect said bearing cap sections.

3. An internal combustion engine as claimed in claim 1, wherein said bearing cap section is in a shape of a plate having two top corner portions which are in contact with said bearing section, and two bottom corner portions which are located opposite to each other with respect to a vertical plane containing a crankshaft axis, in which said first and second projections are positioned at said two bottom corner portions, respectively.

4. An internal combustion engine as claimed in claim 3, wherein said first and second projections are located symmetrical with each other with respect to the vertical plane and so positioned that their axes intersect the vertical plane at an equal angle.

5. An internal combustion engine as claimed in claim 4, wherein said first and second projections are so positioned that their axes are directed to within said bore for the crankshaft journal.

6. An internal combustion engine as claimed in claim 5, wherein each of said first and second projections is formed at its tip with an installation base surface to which each beam member contacts.

7. An internal combustion engine as claimed in claim 6, wherein the installation base surface of each projection is located outside of an envelope of an outer-most loci of a big end of a connecting rod for the crankshaft.

8. An internal combustion engine as claimed in claim 6, wherein each of first and second beam members is formed with a plurality of projections each of which is formed with an installation surface which is in secure contact with the installation base surface of each projection of each bearing cap section by the bolt passing through said bearing cap section projection and said beam member projection.

9. An internal combustion engine as claimed in claim 8, wherein said bolts are so positioned that their axes are directed to within said bore for the crankshaft journal.

* * * * *